US005643102A

United States Patent [19]

Hsien

[11] Patent Number: 5,643,102

[45] **Date of Patent: *Jul. 1, 1997**

[54] GOLF CLUB SET HAVING PROGRESSIVELY OFFSET FACES

[76] Inventor: James C. Hsien, 4601 Stillwater Ct., Concord, Calif. 94521

[ * ] Notice: The term of this patent shall not extend beyond the expiration date of Pat. No. 5,433,439.

[21] Appl. No.: 503,437

[22] Filed: Jul. 17, 1995

Related U.S. Application Data

[63] Continuation-in-part of Ser. No. 121,191, Sep. 15, 1993, Pat. No. 5,433,439.

[51] Int. Cl.[6] ..... A63B 53/04

[52] U.S. Cl. ..... 473/290; 473/314

[58] Field of Search ..... 473/287, 288, 473/289, 290, 242, 324, 314, 340

[56] References Cited

U.S. PATENT DOCUMENTS

| | | | |
|---|---|---|---|
| 2,784,969 | 3/1957 | Brandon | 473/290 |
| 3,655,188 | 4/1972 | Solheim | 473/290 |
| 3,966,210 | 6/1976 | Rozmus . | |
| 4,754,969 | 7/1988 | Kobayashi . | |
| 4,895,367 | 1/1990 | Kajita et al. . | |
| 4,913,435 | 4/1990 | Kobayashi | 473/242 |
| 4,986,541 | 1/1991 | Teramoto et al. . | |
| 5,183,255 | 2/1993 | Antonious | 473/314 |
| 5,433,439 | 7/1995 | Hsien | 473/290 |

*Primary Examiner*—Steven B. Wong
*Attorney, Agent, or Firm*—Richard C. Litman

[57] ABSTRACT

An improved set of golf clubs wherein the face of the head of each golf club is offset relative to the central axis of the shaft of the golf club so as to provide a more consistent swing for golfers. The golf club set comprises progressively numbered wood clubs and progressively numbered iron clubs inclusive of a pitching wedge and sand wedge. The wood clubs and iron clubs each have correspondingly, progressively shorter and less flexible club shafts as well as correspondingly, progressively larger loft angles between the club faces and the shaft axes beginning with the lowest numbered club and progressing through the highest numbered club. The improvement comprises a set of wood and iron clubs each having at least one to seven and one to ten groups of face progression values, respectively. Each group of face progression values varies in accordance with each other group.

11 Claims, 8 Drawing Sheets

GOLF CLUB SET HAVING PROGRESSIVELY OFFSET FACES

CROSS REFERENCE TO RELATED APPLICATION

This is a continuation-in-part of Ser. No. 08/121,191, filed Sep. 15, 1993, now U.S. Pat. No. 5,433,439.

FIELD OF THE INVENTION

The present invention relates to golf clubs and, more particularly, to an improved set of golf clubs wherein the face of the head of each golf club is offset relative to the central axis of the shaft of the golf club.

BACKGROUND OF THE INVENTION

Since its first introduction, the method of playing golf, playing equipment, and playing rules have been refined to a great degree. One area of refinement has been in the development of specific postural positioning, such as in the development of stances and grips, in order to increase the effectiveness of the golf swing. Postural positioning may vary in accordance with a selected club being used, the distance in which the ball is to be driven, and the playing environment.

To successfully master the art of playing golf, one must be proficient in initially driving the ball off the tee, positioning the ball on the green, and putting the ball into the hole. Normally, a wood is used for driving the ball, a putter is used for putting the ball, and an iron is used for most intermediate strokes required to position the ball on the green. A myriad of wood and iron clubs have been developed in order to provide for a relatively fine adjustment of the strokes to be achieved.

A given set of golf clubs includes a plurality of numbered wood and iron clubs as well as a pitching wedge, a sand wedge and a putter. The wood clubs may range in number from one to seven and the irons typically range in number from one to nine. Each club includes shaft and a head defining a face. The lower numbered clubs have longer shafts and the higher numbered clubs have shorter shafts. The face of each club is inclined rearwardly to the vertical axis of the shaft in a direction of the movement of the head of the club when being swung. The value of the angle of the face with respect to the vertical axis of the shaft, that is, the loft angle, increases with an increase in the number of the club or as the shaft length decreases, the sand wedge having the highest loft angle value. The smaller the loft angle, the lower the loft of the ball and the greater the run of the ball after subsequent contact with the ground.

For any set of golf clubs, it is important that the swing of each club be consistent. However, even when golf clubs are swung consistently, the loft changes at impact due to centrifugal forces. Prior art teaches that this tendency to change the loft can be compensated for by providing a set of golf clubs which have progressively decreasing offsets, beginning with the lower numbered clubs and progressively decreasing toward the higher numbered clubs. The offset is the distance between the central axis of the club shaft and the bottom leading edge of the club face. For the most part, the leading edge of the club face actually trails the shaft axis of the clubs having longer shafts and the leading edge of the club face actually precedes the shaft axis of the clubs having shorter shafts. The offset is related to the distance by which the center of the mass of the club head trails the axis of the shaft. Because of the offset and the related position of the center of mass, the centrifugal forces that result about the center of mass of the head, when the club is swung, tend to cause the club to increase its loft angle as the shaft bends. By progressively varying the offset from the lower numbered clubs to the higher numbered clubs, an appropriate degree of consistent loft change can be achieved from club to club.

Golf club sets having clubs with offset club faces are well known in the prior art. For example, U.S. Pat. No. 3,966,210, issued Jun. 29, 1976 to John J. Rozmus, shows two distinct golf club heads each having an offset club face. The leading edge of the ball striking face of each club head is offset so as to precede the vertical axis of the shaft in a direction of the movement of the head of the club when being swung. Another iron golf club set is shown in U.S. Pat. No. 4,986,541, issued Jan. 22, 1991 to Mitsutake Teramoto et al., wherein the set comprises a plurality of iron clubs having different left angles between the face of the golf club head and the axis of the shaft of the club. At least some of the clubs in the set have face progression values which are reduced consecutively or in steps in accordance with a decrease in the number of the iron or a decrease in the value of the loft angle. Two other patents of some relevance to the instant invention are U.S. Pat. Nos. 4,754,969, issued Jul. 5, 1988 to Masashi Kobayashi and 4,895,367, issued Jan. 23, 1990 to Ryota Kajita et al.

Teramoto discloses an iron golf club set comprising a plurality of iron clubs having face progression values which are increased in accordance with an increase in the value of the club number (i.e., the left angle). Teramoto only discloses a plurality of iron clubs having face progression values which are increased in accordance with an increase in the value of the club number. Teramoto makes no mention of decreasing the face progression values for wood golf clubs with increasing club numbers. Kobayashi applies the same teaching to both wood and iron clubs. Neither Kobayashi nor Teramoto discloses a set of wood golf clubs with face progression values that decrease as the progressive wood club numbers increase. While Kajita et al. define a range of values for the offset "y," the reference teaches away from selecting a pattern of offsets as in the present invention. At column 3, lines 62–63, Kajita et al. disclose "all the clubs of such a golf club [set] have a feeling close to that of irons." In column 3, line 67 through column 2, line 4, Kajita et al. expressly state that "it is possible also to set y of the iron clubs so as to be in accordance with the feeling of the conventional wood clubs." Therefore Kajita et al. specifically teach that one would select offset progressions which are modeled after a conventional club set so that the woods match the offsets of a set of irons, or vice versa, with the offset value increasing as the number of the club increases.

The present invention uses offsets which are contrary to those taught by Kajita et al., with the offset or "face progression value" of Applicant's woods decreasing as the wood numbers increase. The face progression values for the woods herein are the opposite of those disclosed by Kajita et al., Koboyashi, and Teramoto et al. The offsets of the instant invention uniquely allow the golfer to use a single swing to produce a sweeping motion with the woods, a down and through motion with the higher numbered irons, and a combination swing with the lower numbered irons. Through the use of the offsets of the instant invention, the head of the golf club will be properly positioned relative to the hands of the user at the point of impact based on a single swing. With the conventional offsets taught by Kajita et al., the golfer must adjust his swing for the longer or shorter irons to have the proper hand positioning with each club at the point of impact. Therefore, the teachings of Kajita et al. wherein the woods emulate the irons or vice versa is insufficient to enable one skilled in the art to arrive at a solution to the problem which forms the basis of the present invention.

All of the problems associated with achieving a timely impact of the golf club with the ball have yet to be addressed. A golf club set which offers a variation in face progression values including face progression plus values, zero values, and minus values would meet the needs to achieving a timely impact of the golf club with the ball. Applicant proposes a golf club set having such a variation in face progression values. None of the above noted patents, either singly or in combination, are seen to disclose the specific arrangement of concepts disclosed by applicant with respect to the present invention.

SUMMARY OF THE INVENTION

By the present invention, an improved set of golf clubs wherein the face of the head of each golf club is offset relative to the central axis of the shaft of the golf club so as to provide a more consistent swing for golfers, particularly novice and average golfers, is disclosed. The golf club set comprises wood clubs numbered from one through seven, iron clubs numbered from one through nine, and a pitching wedge and/or a sand wedge. The wood and iron clubs each have correspondingly, progressively shorter and less flexible club shafts as well as correspondingly, progressively larger loft angles between the club faces and the shaft axes beginning with the lowest numbered club and progressing through the highest numbered club or the pitching and sand wedge. The improvement comprises a set of wood clubs having at least four groups of face progression values. Each group of face progression values varies in accordance with each other group.

Accordingly, one of the objects of the present invention is to provide a set of golf clubs which include face progression values which allow a golfer to more consistently control his or her posture and positioning.

Another object is that such a golf club set provide for more consistent transfer of weight by the golfer.

Still another object is to provide for variable offset, depending upon the number of the club and/or angle of the club head face, to compensate for the variation in the flex of the club shaft depending on the number of the club and/or the loft angle of the club face.

It is an object of the invention to provide improved elements and arrangements thereof in an apparatus for the purposes described which is inexpensive, dependable and fully effective in accomplishing its intended purposes.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DETAILED DESCRIPTION OF THE PREFERRED EMBODIMENTS

Figure 1:
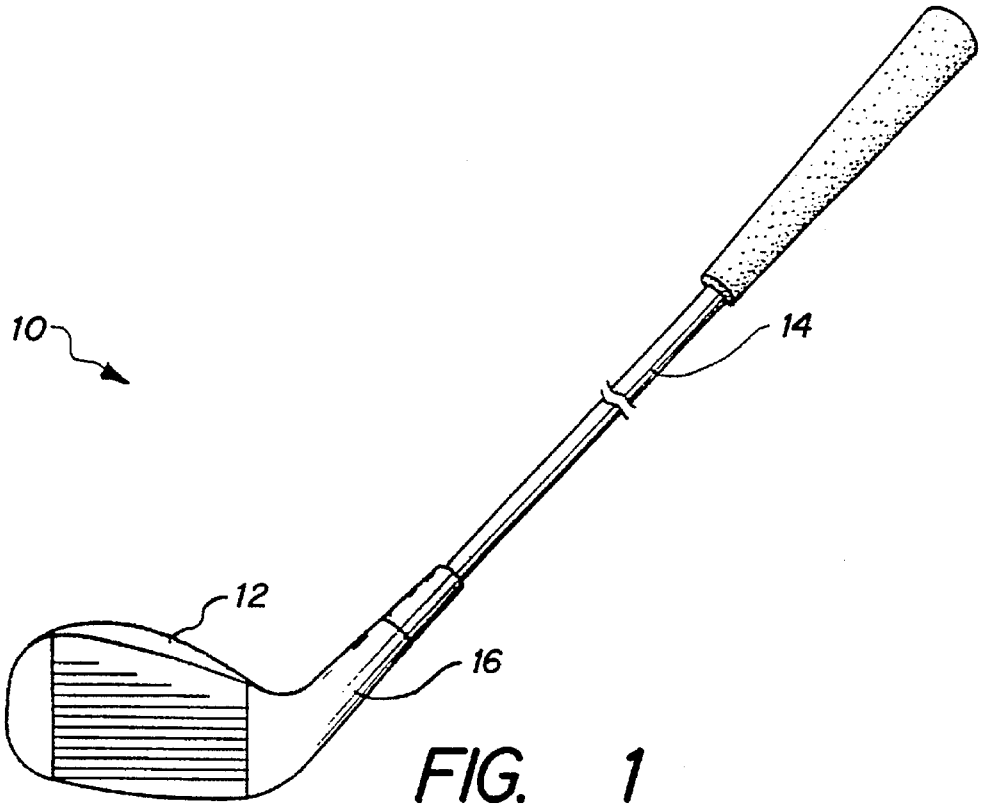
FIG. 1 is a partially broken, front elevational view of a wood club.
Figure 2:
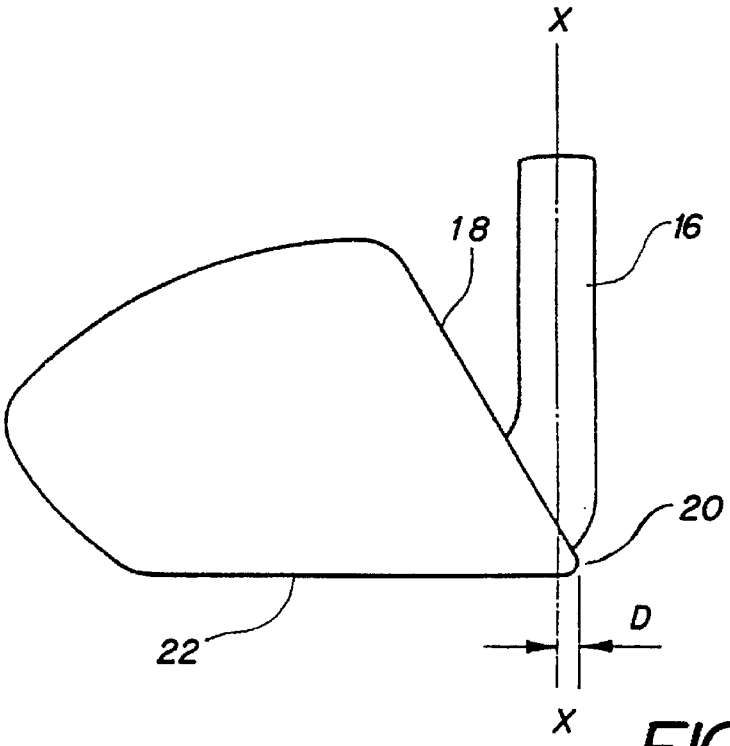
FIG. 2 is a fragmentary side elevational view of the head of the wood club shown in FIG. 1.

Now referring to the drawings and, more particularly, to FIGS. 1 and 2, there is shown a wood club 10 having a head 12 and a shaft 14 joined to the head 12 by a hosel 16 which is an integral part of the head 12. The head 12 includes a face 18 defined by a flat plane which is inclined rearwardly with respect to the vertical axis X—X of the club shaft 14. The face 18 has a bottom leading edge 20. The head 12 further includes a sole 22 extending rearwardly from the bottom leading edge 20 of the face 18.

Figure 3:
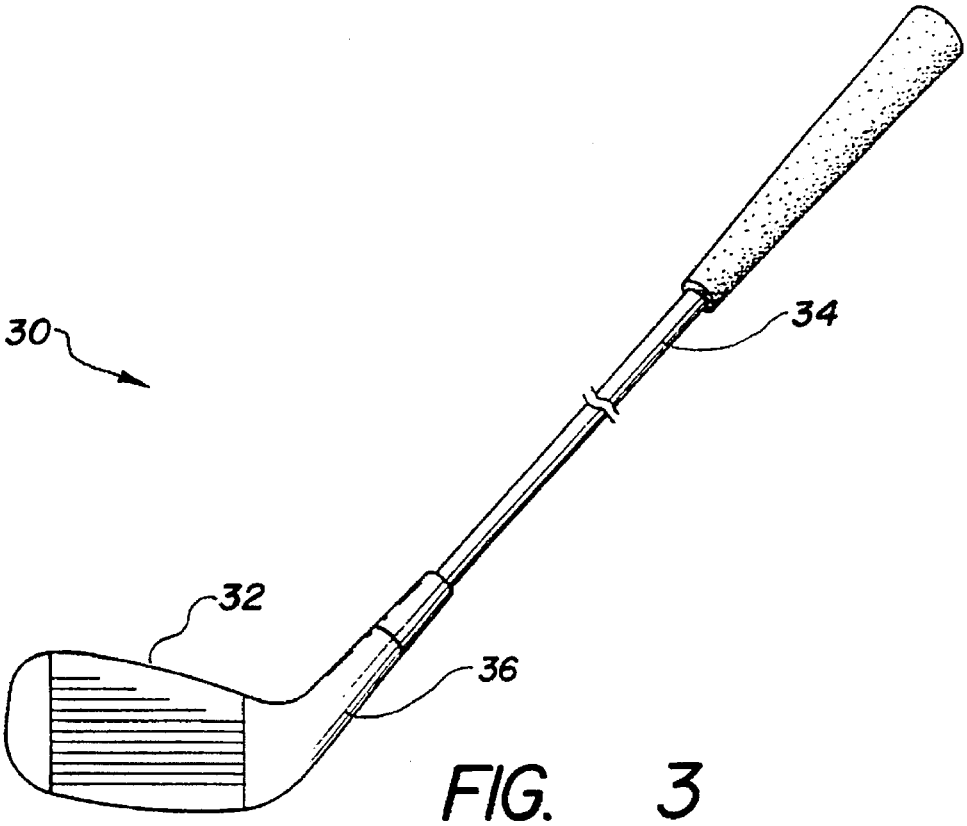
FIG. 3 is a side elevational view of a head of an iron club.
Figure 4:
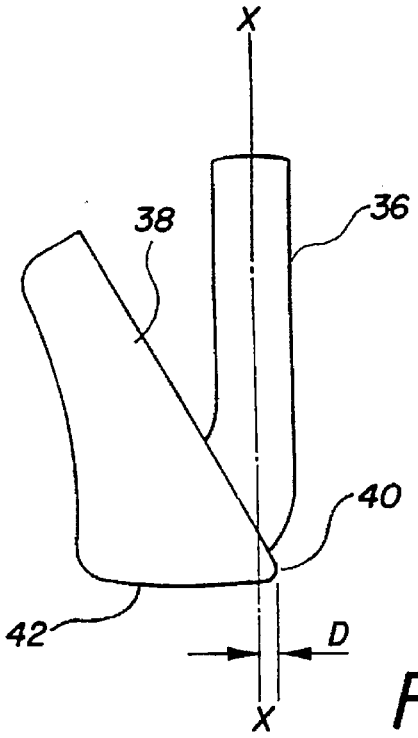
FIG. 4 is a fragmentary side elevational view of the head of the iron club shown in FIG. 3.

As shown in FIGS. 3 and 4, an iron club 30 includes an iron club head 32, a shaft 34, and a hosel 36 joining the head 32 to the shaft 34. The club head 32 includes a face 38 having a bottom leading edge 40, and a sole 42 extending rearwardly from the bottom leading edge 40 of the face 38.

Figure 5:
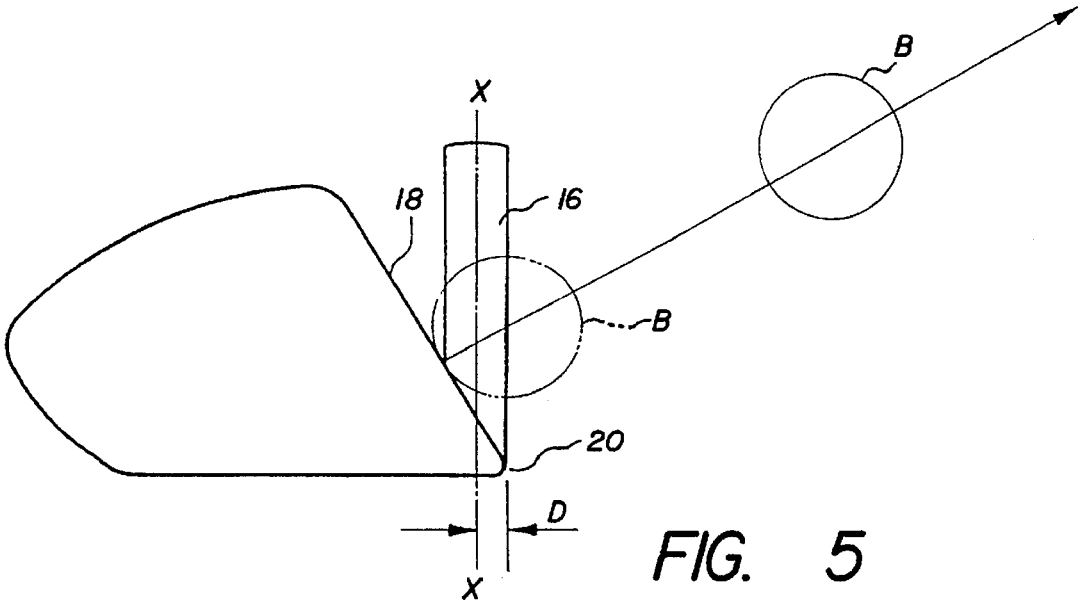
FIG. 5 shows the loft of a ball when hit by a wood club having a face progression plus value.
Figure 6:
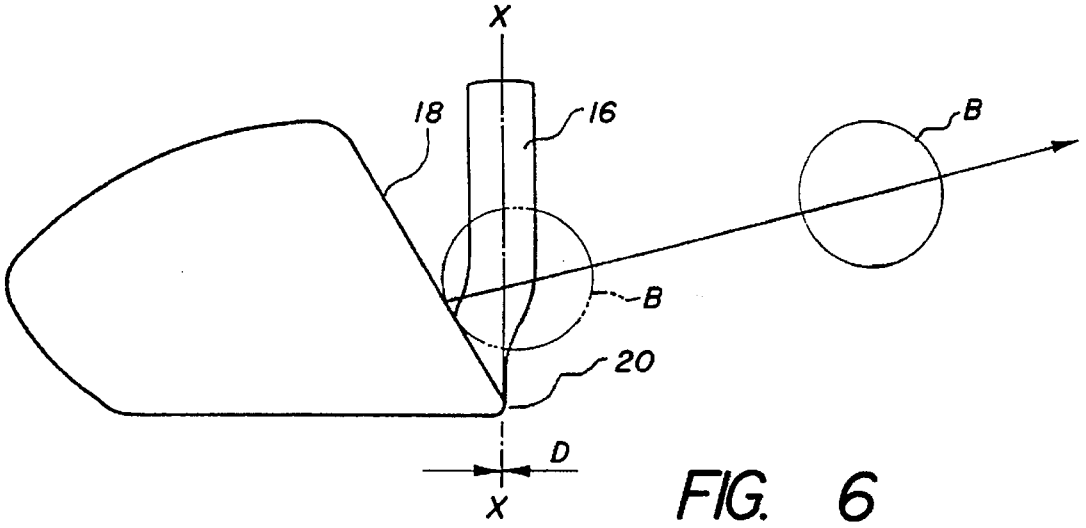
FIG. 6 shows the loft of a ball when hit by a wood club having a face progression zero value.
Figure 7:
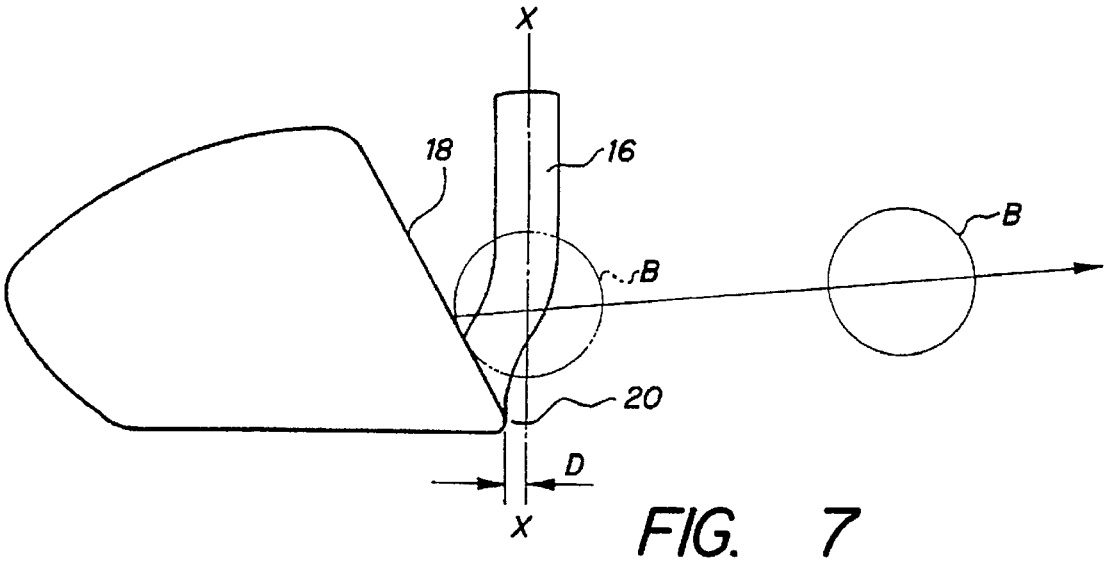
FIG. 7 shows the loft of a ball when hit by a wood club having a face progression minus value.

FIGS. 5 through 7 show the hosel 16 of the wood club 10 having a central axis X—X which coincides with the vertical axis of the clubshaft 14. A distance D is formed between the central axis X—X of the club shaft 14 and the bottom leading edge 20 of the club face 18. This distance D is referred to as the face progression.

The value of the face progression FP has an effect on the loft (trajectory) of a golf ball B. A configuration wherein the bottom leading edge 20 of the face 18 is located forward of the central axis X—X, as is shown in FIG. 5, in the direction of the movement of the head 12 when the club 10 is swung, herein referred to as face progression plus value, will increase the height of the loft of the ball B. A configuration wherein the bottom leading edge 20 of the face 18 is located on the central axis X—X, as is shown in FIG. 6, herein referred to as a face progression zero value, will provide a medium loft of the ball B. Moreover, a configuration wherein the bottom leading edge 20 of the face 18 is located rearward of the central axis X—X, as is shown in FIG. 7, in the direction of the movement of the head 12 when the club 10 is swung, herein referred to as a face progression minus value, will provide a low loft of the ball B.

Figure 8:
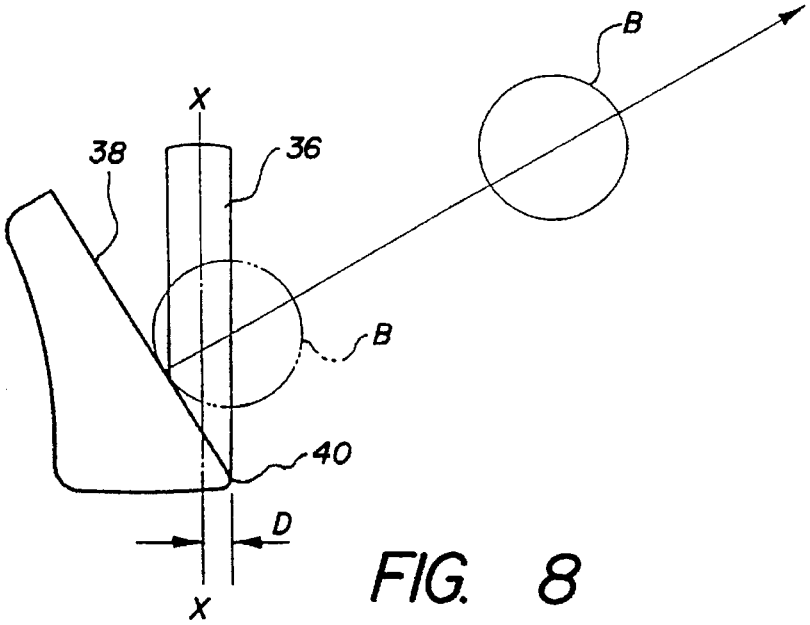
FIG. 8 shows the loft of a ball when hit by an iron club having a face progression plus value.
Figure 9:
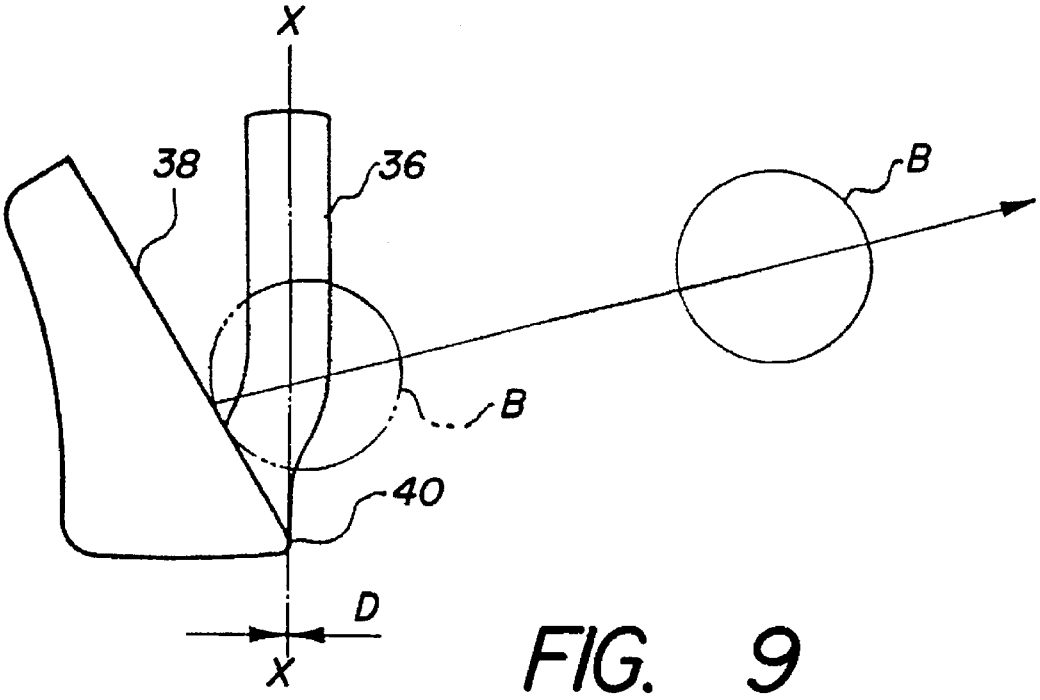
FIG. 9 shows the loft of a ball when hit by an iron club having a face progression zero value.
Figure 10:
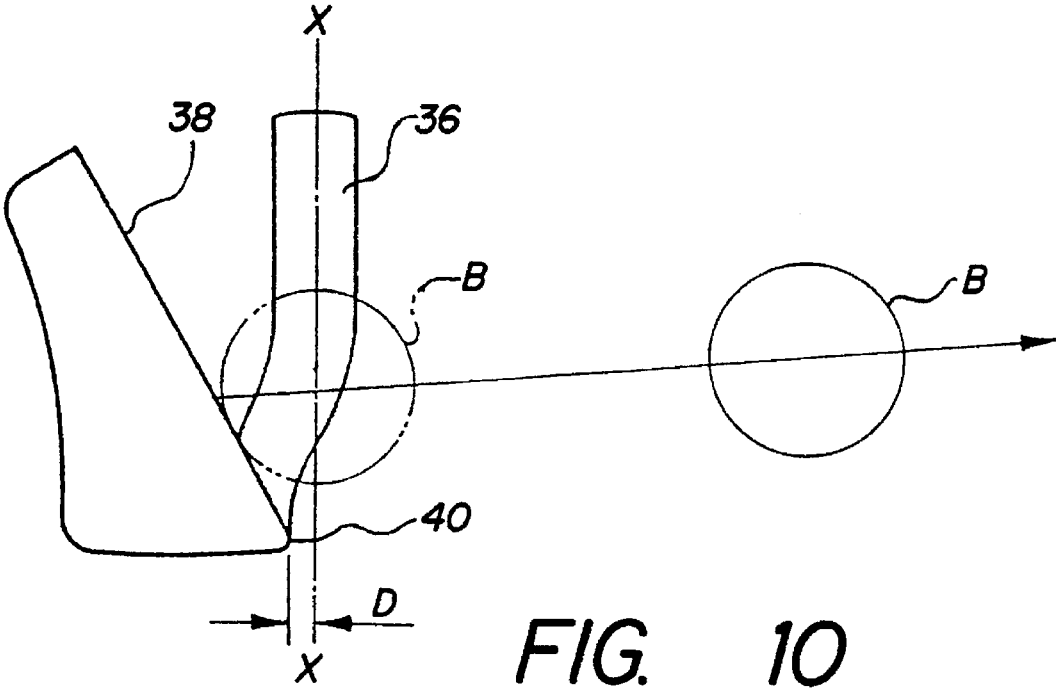
FIG. 10 shows the loft of a ball when hit by an iron club having a face progression minus value.

Similar to that of the above mentioned wood clubs, as shown in FIGS. 8 through 10, the hosel 36 of the iron club 30 has a central axis X—X which coincides with the central axis of the club shaft 34. A distance D is formed between the central axis X—X of the club shaft 34 and the bottom leading edge 40 of the club face 38; this distance D is referred to as the face progression. The configuration, as is shown in FIG. 8, is referred to as a face progression plus value; the configuration shown in FIG. 9 is referred to as a face progression zero value; and the configuration shown in FIG. 10 is referred to as a face progression minus value. With respect to the loft of the ball B relative to the loft angles, the same underlying principles apply to the iron clubs as apply to the wood clubs as discussed above.

Figure 11:
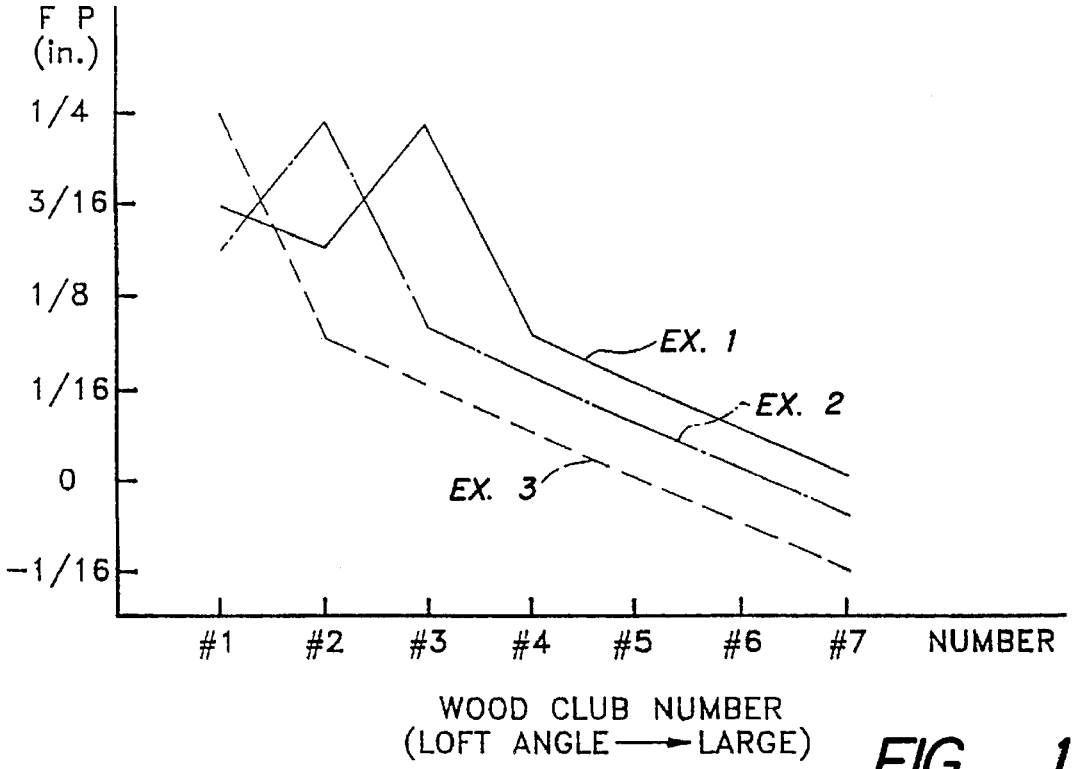
FIGS. 11 and 12 show a relationship between the number of a wood club and the face progression value according to the various embodiments of a wood club set of the present invention.

By the present invention, wood clubs have face progression values FP which increase for the intermediate clubs, clubs ranging between clubs numbered 2 through 4, then decrease with an increase in the loft angle of the face of the club. Three examples of wood club sets are shown in TABLE I showing face progression values FP in inches. There are seven groups of face progression values or seven face progression values, a different face progression value for each club. FIG. 11 shows a relationship between each golf club number and its face progression value.

TABLE I (Seven Groups in a set of woods):

| FP value (inch) | Wood Club No. Driver & #1 | #2 | #3 | #4 | #5 | #6 | #7 |
|---|---|---|---|---|---|---|---|
| Ex. 1 | ¼ | 3/16 | 5/32 | 3/32 | 1/16 | 1/32 | 0 |
| Ex. 2 | ¼ | 5/32 | 3/32 | 1/16 | 1/32 | 0 | −1/32 |
| Ex. 3 | ¼ | 3/32 | 1/16 | 1/32 | 0 | −1/32 | −1/16 |

In example 1 (Ex. 1), the face progression value is first decreased in club No. 2 from club No. 1, then slightly decreased in club No. 3 from club No. 2, and then successively decreased in value from club No. 3 through club No. 7, sharply from club No. 3 to club No. 4, and steadily from club No. 4 through club No. 7, as the loft angle increases. In example 2 (Ex. 2), the face progression value is first sharply decreased in club No. 2 from club No. 1, then less sharply decreased in club No. 3 from club No. 4, then successively decreased in value from club No. 4 through club No. 7. In example 3 (Ex. 3), the face progression value sharply decreases in club No. 2 from club No. 1, and then successively decreases in value from club No. 3 through club No. 7.

Figure 12:
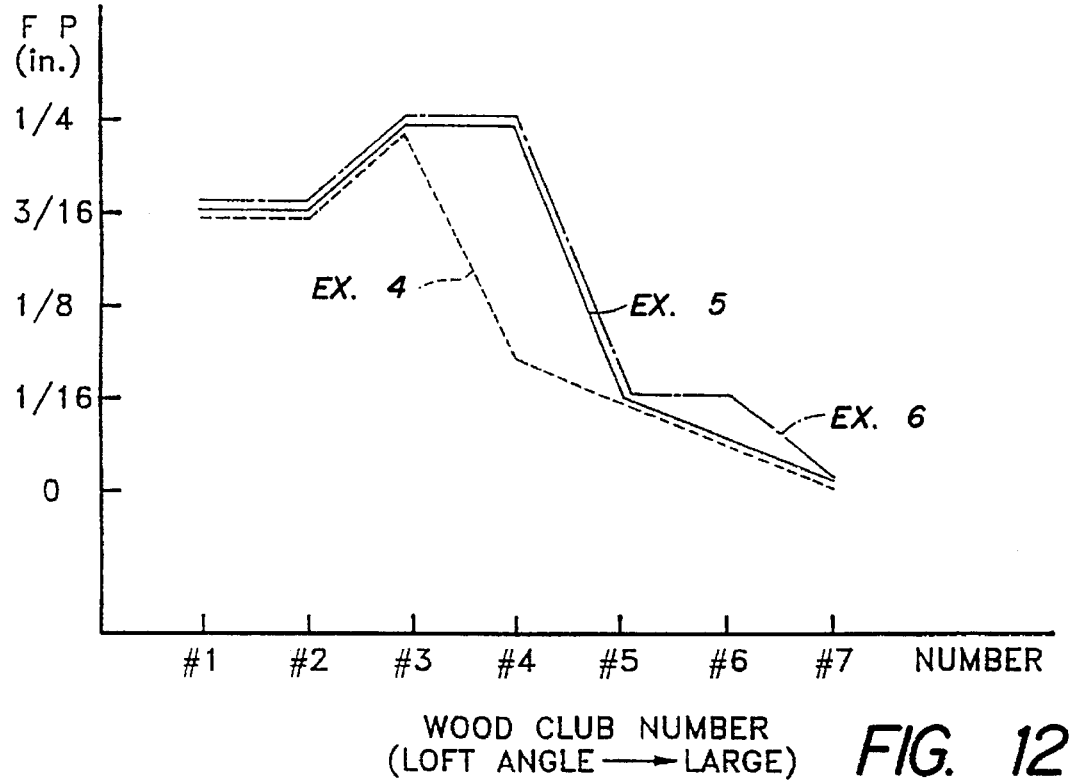

Another three examples are shown in TABLES II, III and IV. FIG. 12 shows a relationship between the golf club number and the face progression value.

TABLE II (Six Groups in a set of woods):

| FP value (inch) | Wood Club No. Driver & #1 | #2 | #3 | #4 | #5 | #6 | #7 |
|---|---|---|---|---|---|---|---|
| Ex. 4 | ¼ | 3/16 | 3/16 | 3/32 | 1/16 | 1/32 | 0 |

In example 4 (Ex. 4), six groups of face progression values are included in each set, that is to say, the value of two consecutive clubs remains constant. FIG. 12 shows a relationship between each golf club number and its face progression values shown in TABLE II. The face progression value is decreased in club No. 2 from club No. 1, then maintained constant in clubs Nos. 2 and 3, and then first successively decreased sharply in value from club No. 3 to club No. 4 and then decreased more gradually from club No. 4 through club No. 7.

TABLE III (Five Groups in a set of woods):

| FP value (inch) | Wood Club No. Driver & #1 | #2 | #3 | #4 | #5 | #6 | #7 |
|---|---|---|---|---|---|---|---|
| Ex. 5 | ¼ | ¼ | 3/16 | 3/16 | 1/16 | 1/32 | 0 |

In example 5 (Ex. 5), five groups of face progression values are included in each set, or five face progression values are provided for the seven clubs in the set. The value of clubs No. 1 and 2 consecutive clubs remains constant, then the value of clubs No. 3 and 4 remains constant. The face progression value is decreased in club No. 3 from club No. 2, and then first successively decreased sharply in value from club No. 4 to club No. 5 and then decreased more gradually from club No. 6 to club No. 7.

TABLE IV (Four Groups in a set of woods):

| FP value (inch) | Wood Club No. Driver & #1 | #2 | #3 | #4 | #5 | #6 | #7 |
|---|---|---|---|---|---|---|---|
| Ex. 6 | ¼ | ¼ | 3/16 | 3/16 | 1/16 | 1/16 | 0 |

In example 6 (Ex. 6), four groups of face progression values are included in each set, that is to say, four face progression values are provided for the seven clubs in the set. The value of clubs No. 1 and 2 remains constant, then the value of clubs No. 3 and 4 remains constant, and finally the value of clubs No. 5 and 6 remains constant. The face progression value is decreased in club No. 3 from club No. 2, then decreased sharply in value in club No. 5 from club No. 4, and then decreased more gradually in club No. 7 from club No. 6.

Figure 13:
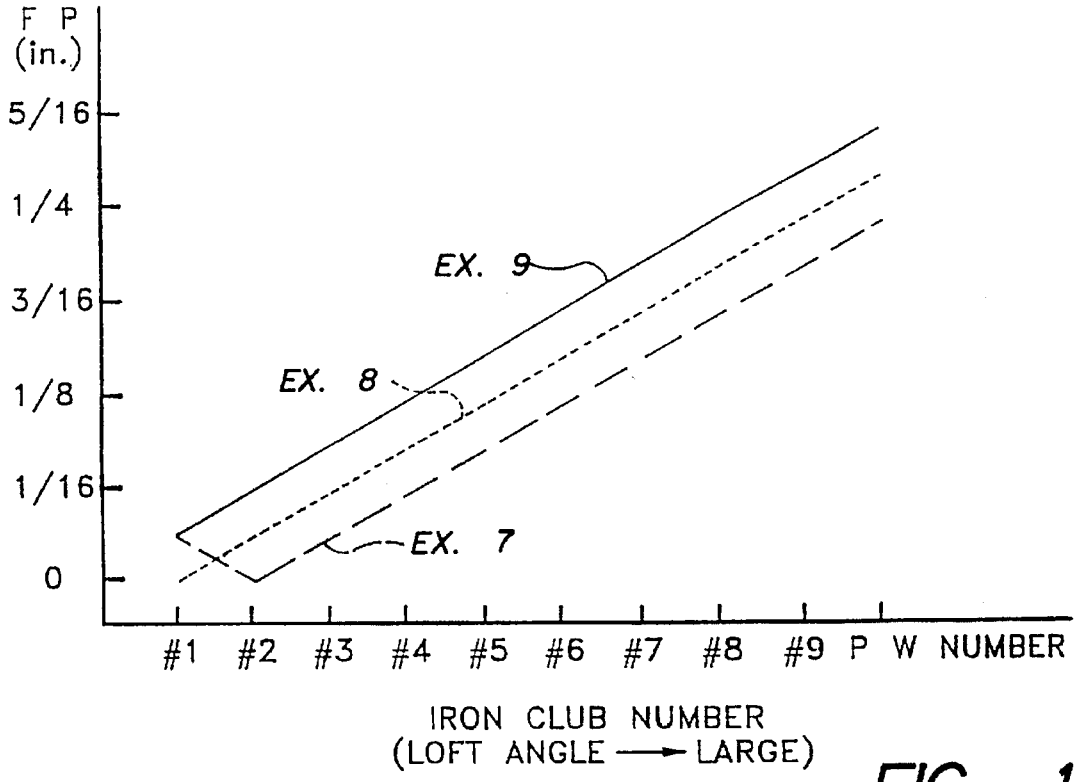
FIGS. 13 through 15 show a relationship between the number of an iron club and the face progression value according to the various embodiments of an iron club set of the present invention.

Unlike wood clubs, iron clubs have face progression values FP which, for the most part, increase with an increase in the loft angle of the face of the club. Three examples of iron club sets are shown in TABLE V. These sets comprise ten groups of face progression values or ten face progression values, a different face progression value for each club. FIG. 13 shows a relationship between each golf club number and its face progression value.

TABLE V

9/24 (Ten Groups in a set of irons):

| FP value (inch) | Iron Club No. #1 | #2 | #3 | #4 | #5 | #6 | #7 | #8 | #9 | SW & PW |
|---|---|---|---|---|---|---|---|---|---|---|
| Ex. 7 | 1/32 | 0 | 1/32 | 1/16 | 3/32 | 1/8 | 5/32 | 3/16 | 7/32 | ¼ |
| Ex. 8 | 0 | 1/32 | 1/16 | 3/32 | 1/8 | 5/32 | 3/16 | 7/32 | ¼ | 9/32 |
| Ex. 9 | 1/32 | 1/16 | 3/32 | 1/8 | 5/32 | 3/16 | 7/32 | ¼ | 9/32 | 5/16 |

In example 7 (Ex. 7), the face progression value is first decreased in club No. 2 from club No. 1, then successively increased in value from club No. 2 through the pitching wedge. In examples 8 and 9 (Ex. 8 and 9), the face progression values successively increase in value linearly from club No. 1 through the pitching wedge.

Figure 14:
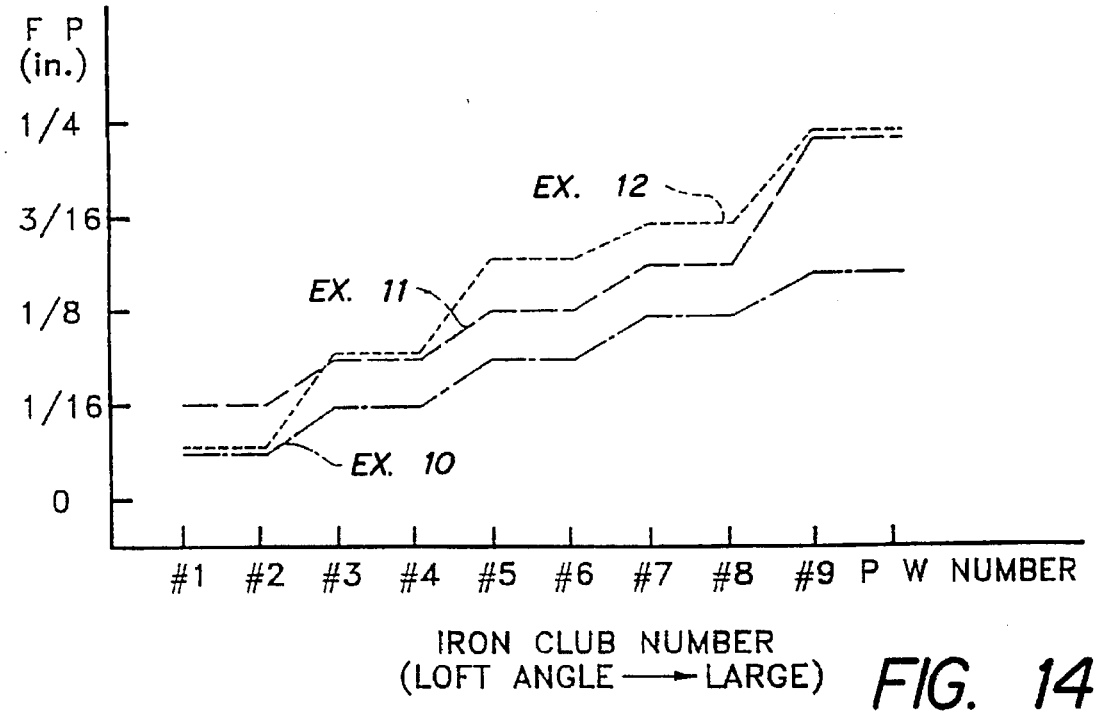

Another three examples of iron club sets are shown in TABLE VI and FIG. 14 shows a relationship between each club number and its face progression value of these clubs.

TABLE VI (Five Groups in a set of irons):

| FP value | Iron Club No. | | | | | | | | | |
|---|---|---|---|---|---|---|---|---|---|---|
| (inch) | #1 | #2 | #3 | #4 | #5 | #6 | #7 | #8 | #9 | SW & PW |
| Ex. 10 | 1/32 | 1/32 | 1/16 | 1/16 | 3/32 | 3/32 | 1/8 | 1/8 | 5/32 | 5/32 |
| Ex. 11 | 1/16 | 1/16 | 3/32 | 3/32 | 1/8 | 1/8 | 5/32 | 5/32 | 1/4 | 1/4 |
| Ex. 12 | 1/32 | 1/32 | 3/32 | 3/32 | 5/32 | 5/32 | 3/16 | 3/16 | 1/4 | 1/4 |

In examples 10 through 12 (Ex. 10 through 12), the face progression values successively increases in value from club No. 1 through the pitching wedge. These clubs sets comprising five groups of face progression values, wherein the face progression values increase in steps with each odd numbered club and each even numbered club has a face progression value which is equivalent to the face progression value of the immediately preceding odd numbered club.

Figure 15:
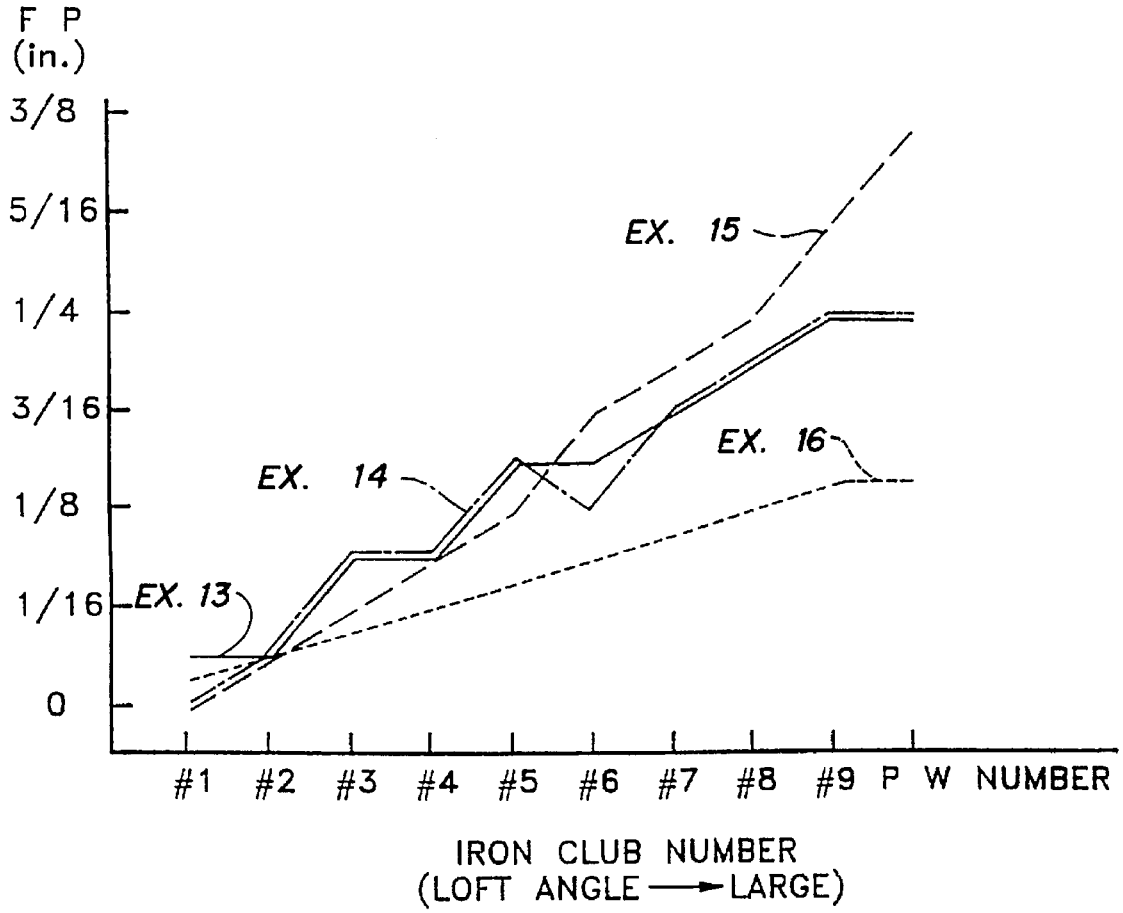

Four other examples of iron club sets are shown in TABLE VII through X. FIG. 15 shows a relationship between each club number and its face progression value.

TABLE VII (Six Groups in a set of irons):

| FP value | Iron Club No. | | | | | | | | | |
|---|---|---|---|---|---|---|---|---|---|---|
| (inch) | #1 | #2 | #3 | #4 | #5 | #6 | #7 | #8 | #9 | SW & PW |
| Ex. 13 | 1/32 | 1/32 | 3/32 | 3/32 | 5/32 | 5/32 | 3/16 | 7/32 | 1/4 | 1/4 |

In example 13 (Ex. 13), the face progression values increase in value stepwise from club No. 1 through the pitching wedge. These clubs sets comprise six groups of face progression values, wherein the face progression values are held constant for clubs No. 1 and 2; No. 3 and 4; and No. 5 and 6.

TABLE VIII (Seven Groups in a set of irons):

| FP value | Iron Club No. | | | | | | | | | |
|---|---|---|---|---|---|---|---|---|---|---|
| (inch) | #1 | #2 | #3 | #4 | #5 | #6 | #7 | #8 | #9 | SW & PW |
| Ex. 14 | 0 | 1/32 | 3/32 | 3/32 | 5/32 | 1/8 | 3/16 | 7/32 | 1/4 | 1/4 |

In example 14 (Ex. 14), akin to that of example 13, the face progression values increase in value stepwise from club No. 1 through club No. 5, club No. 6 decreases in value from club No. 5, and then the clubs proceeding club No. 6 increase in value from club No. 6 through club No. 9. The face progression value of the pitching wedge is equivalent to that of the No. 9 club. Hence, seven face progression values are provided in this set thus producing sevens groups of face progression values in this set.

TABLE IX (Eight Groups in a set of irons):

| FP value | Iron Club No. | | | | | | | | | |
|---|---|---|---|---|---|---|---|---|---|---|
| (inch) | #1 | #2 | #3 | #4 | #5 | #6 | #7 | #8 | #9 | SW & PW |
| Ex. 15 | 0 | 1/32 | 1/16 | 3/32 | 1/8 | 3/16 | 7/32 | 1/4 | 1/4 | 3/8 |

In example 15 (Ex. 15), the face progression values increase steeply from club No. 1 through the pitching wedge. These clubs sets consist of eight groups of face progression values. And lastly, example 16 (Ex. 16), nine groups of face progression values are shown. For the most part, the face progression for this set of irons is substantially linear.

TABLE X (Nine Groups in a set of irons):

| FP value | Iron Club No. | | | | | | | | | |
|---|---|---|---|---|---|---|---|---|---|---|
| (inch) | #1 | #2 | #3 | #4 | #5 | #6 | #7 | #8 | #9 | SW & PW |
| Ex. 16 | 1/64 | 1/32 | 3/64 | 1/16 | 5/64 | 3/32 | 7/64 | 1/8 | 9/64 | 9/64 |

Accordingly, a set of golf clubs is provided which includes face progression values which allow a golfer to more consistently control his or her posture and positioning as well as provide a more consistent transfer of weight by the golfer. The wood clubs in combination with the iron clubs provide a wide variation in offsets, depending upon the number of the club and/or angle of the club head face. Compensation is provided for the variation in the flex of the club shaft depending on the number of the club and/or the loft angle of the club face.

Moreover, it has been found that the number of groups of woods may range from one to seven, and the number of groups of irons may range from one to ten. The clubs in any one group will, of course, have the same face progression value. In preferred embodiments of the invention, iron face progression values are in 1/64 and/or 1/32 inch increments, and wood face progression values are in 1/32 and/or 1/16 inch increments.

It is to be understood that the present invention is not limited to the embodiments described above, but encompasses any and all embodiments within the scope of the following claims.

I claim:

1. A set of golf clubs comprising:

a plurality of progressively numbered wood clubs; each wood club having:

a wood shaft having a vertical axis;

a wood head joined to said wood shaft, said wood head having a bottom leading edge, and a wood face which is rearwardly inclined at an angle relative to said vertical axis of said wood shaft, said angle of said wood face increasing with an increase in progressive numbering of said wood club; and a wood face progression value, said wood face progression value being a distance between said vertical axis of said wood shaft and said bottom leading edge of said wood face, said wood clubs being divided into a predetermined number of wood groups ranging from two to seven, said wood clubs in each one of said wood groups having progressive wood numbers corresponding to said angle of said wood face, said wood clubs in any one wood group having an equivalent wood face progression value while said wood face progression value between said wood groups decreases within the range of from 1/32 inch to 3/16 inch as said progressive wood numbers increase.

2. The golf club set according to claim 1, wherein the increase of said wood progression value between wood groups is 1/32 inch.

3. The golf club set according to claim 1, wherein the increase of said wood progression value between wood groups is 1/16 inch.

4. The golf club set according to claim 1, further comprising:

a plurality of progressively numbered iron clubs; each iron club having:

an iron shaft having a vertical axis;

an iron head joined to said iron shaft, said iron head having a bottom leading edge, and an iron face which is rearwardly inclined at an angle relative to said vertical axis of said iron shaft, said angle of said iron face increasing with an increase in progressive numbering of said iron club; and an iron face progression value, said iron face progression value being a distance between said vertical axis of said iron club and said bottom leading edge of said iron face, said iron clubs being divided into a predetermined number of iron groups ranging from two to ten, said iron clubs in each one of said iron groups having progressive iron numbers corresponding to the angle of said iron face, said iron clubs in any one iron group have an equivalent iron face progression value while said iron face progression value between said iron groups increases as said progressive iron numbers increase.

5. The golf club set according to claim 4, wherein the increase of said iron progression value between iron groups is from 1/64 inch to 3/16 inch.

6. The golf club set according to claim 4, wherein the increase of said iron progression value between iron groups is 1/64 inch.

7. The golf club set according to claim 4, wherein the increase of said iron progression value between iron groups is 1/32 inch.

8. The golf club set according to claim 4, wherein the increase of said wood progression value between wood groups is 1/32 inch and the increase of said iron progression value between iron groups is 1/32 inch.

9. A set of golf clubs comprising:

a plurality of progressively numbered iron clubs; each iron club having:

an iron shaft having a vertical axis;

an iron head joined to said iron shaft, said iron head having a bottom leading edge, and an iron face which is rearwardly inclined at an angle relative to said vertical axis of said iron shaft, said angle of said iron face increasing with an increase in progressive numbering of said iron club; and an iron face progression value, said iron face progression value being a distance between said vertical axis of said iron club and said bottom leading edge of said iron face, said iron clubs being divided into a predetermined number of iron groups ranging from two to ten, said iron clubs in each one of said iron groups having progressive iron numbers corresponding to the angle of said iron face, said iron clubs in any one iron group have an equivalent iron face progression value while said iron face progression value between said iron groups increases within a range of from 1/64 inch to 3/16 inch as said progressive iron numbers increase.

10. The golf club set according to claim 9, wherein the increase of said iron progression value between iron groups is 1/64 inch.

11. The golf club set according to claim 9, wherein the increase of said iron progression value between iron groups is 1/32 inch.

* * * * *